US008559644B2

(12) United States Patent
Chung et al.

(10) Patent No.: US 8,559,644 B2
(45) Date of Patent: Oct. 15, 2013

(54) APPARATUS FOR SOUND HAVING MULTIPLES STEREO IMAGING

(76) Inventors: Won Sup Chung, Cheongju-si (KR); Uk Don Choi, Seoul (KR)

( * ) Notice: Subject to any disclaimer, the term of this patent is extended or adjusted under 35 U.S.C. 154(b) by 374 days.

(21) Appl. No.: 12/733,194

(22) PCT Filed: Nov. 14, 2008

(86) PCT No.: PCT/KR2008/006725
§ 371 (c)(1),
(2), (4) Date: Jul. 19, 2010

(87) PCT Pub. No.: WO2009/066906
PCT Pub. Date: May 28, 2009

(65) Prior Publication Data

US 2010/0296657 A1 Nov. 25, 2010

(30) Foreign Application Priority Data

Nov. 23, 2007 (KR) ..... 10-2007-0120165

(51) Int. Cl.
*H04R 5/00* (2006.01)

(52) U.S. Cl.
USPC ..... 381/28; 381/1; 381/120

(58) Field of Classification Search
USPC ..... 381/28, 120, 300, 1, 17, 97, 98, 103, 381/104
See application file for complete search history.

(56) References Cited

U.S. PATENT DOCUMENTS

| | | | | |
|---|---|---|---|---|
| 3,697,692 | A * | 10/1972 | Hafler | 381/18 |
| 3,818,136 | A * | 6/1974 | Schott | 381/21 |
| 5,333,200 | A * | 7/1994 | Cooper et al. | 381/1 |
| 5,333,201 | A * | 7/1994 | Waller, Jr. | 381/22 |
| 5,434,921 | A * | 7/1995 | Dombrowski et al. | 381/1 |
| 5,469,509 | A * | 11/1995 | Navone et al. | 381/28 |
| 5,530,760 | A * | 6/1996 | Paisley | 381/27 |
| 6,829,359 | B2 | 12/2004 | Serrano | |
| 7,564,982 | B1 * | 7/2009 | Ambourn | 381/120 |
| 7,664,271 | B2 * | 2/2010 | Suzaki et al. | 381/10 |
| 8,041,040 | B2 * | 10/2011 | Imaki | 381/1 |
| 8,121,318 | B1 * | 2/2012 | Ambourn et al. | 381/307 |
| 2003/0059067 | A1 * | 3/2003 | Shibata | 381/119 |
| 2004/0247132 | A1 * | 12/2004 | Klayman et al. | 381/1 |
| 2005/0089178 | A1 | 4/2005 | Asada et al. | |

(Continued)

FOREIGN PATENT DOCUMENTS

| | | | |
|---|---|---|---|
| JP | 08280100 | A * | 10/1996 |
| JP | 2003230190 | | 8/2003 |

(Continued)

*Primary Examiner* — Xu Mei
(74) *Attorney, Agent, or Firm* — Cooper & Dunham LLP

(57) ABSTRACT

The present invention provides an apparatus for sound comprising a sound source generating unit for generating an electric signal from a sound source, N (N≥2) amplifiers which are connected in series so that the output part of one amplifier is connected with the input part of the other amplifier and one of them is connected with the sound source generating unit, and 2N speakers which are respectively connected with left and right output parts of each of the N amplifiers. According to one aspect of the invention there is formed a multiple stereo imaging including a first stereo imaging, a first mono imaging, a second mono imaging and a second stereo imaging generated by the first mono imaging and the second mono imaging.

6 Claims, 5 Drawing Sheets

110 : a sound source generating unit 121, 122 : amplifier 231, 232, 233, 234 : speaker 240 : first stereo imaging 251 : first mono imaging 252 : second mono imaging 260 : second stereo imaging

(56) References Cited

U.S. PATENT DOCUMENTS

| | | | | |
|---|---|---|---|---|
| 2006/0023889 | A1* | 2/2006 | Suzaki et al. | 381/17 |
| 2007/0273790 | A1 | 11/2007 | Sakata et al. | |
| 2009/0097675 | A1* | 4/2009 | Kikumoto et al. | 381/107 |
| 2009/0154738 | A1* | 6/2009 | Pal | 381/309 |
| 2009/0252338 | A1* | 10/2009 | Koppens et al. | 381/17 |
| 2011/0235809 | A1* | 9/2011 | Schuijers et al. | 381/17 |

FOREIGN PATENT DOCUMENTS

| | | |
|---|---|---|
| JP | 2005130169 | 5/2005 |
| JP | 2007243563 | 9/2007 |
| JP | 2007243772 | 9/2007 |

* cited by examiner

110 : a sound source generationg unit 121, 122 : amplifier 131, 132, 133, 134 : speaker 140 : first stereo imaging 151 : first mono imaging 152 : second mono imaging 160 : second stereo imaging 110 : a sound source generating unit 121, 122 : amplifier 231, 232, 233, 234 : speaker 240 : first stereo imaging 251 : first mono imaging 252 : second mono imaging 260 : second stereo imaging 110 : a sound source generating unit 320 : a single case 321, 322 : amplifier 331, 332, 333, 334 : speaker

APPARATUS FOR SOUND HAVING MULTIPLES STEREO IMAGING

REFERENCE TO RELATED APPLICATIONS

The present disclosure is based on and claims benefit from PCT International Application No. PCT/KR2008/006725 filed Nov. 14, 2008 which claims priority from Korean Patent Application No. 10-2007-0120165 filed Nov. 23, 2007, the entire contents of each of which are herein incorporated by reference.

TECHNICAL FIELD

The present invention relates to an apparatus for sound using resonance and sound image effect due to coupling of a plurality of amplifiers and speakers.

BACKGROUND ART

The factor in defining sound property includes a pitch, an intensity and a tone color of sound. The pitch of sound is determined by a musical interval and a frequency, and an audio frequency (20 Hz~20 kHz) is generally divided into a high range component, a middle range component and a low range component.

A good sound balance can be achieved by uniformly including high range sound, middle range sound and low range sound without leaning of the sound to one side. The intensity of sound is associated with a dynamic range of a sound apparatus, and means a different width between a sound of little volume and a sound of large volume. And the tone color of sound is generated by a mode of sound and a harmonic tone.

The sound apparatus for reproducing sound as analog sound wave from a sound source includes a stereo audio comprised of an amplifier and a set of (two) speakers to realize stereo sound, a 2.1, 3.1, 4.1, 5.1 or 7.1-channel audio system comprised of a multi-channel amplifier and 3, 4, 5, 6 or 8 speakers, and a multi-amplifier audio system in which a plurality of amplifying circuits are provided and speakers for low-pitched sound, middle-pitched sound and high-pitched sound are respectively connected with a separate amplifier so as to amplify the sounds in accordance with an output frequency band.

Since the conventional stereo system or multi-channel and multi-amplifier system is focused on realizing the stereo sound, it is possible to excellently realize the stereo sound.

However, there is not a function of delicately controlling each bass, baritone and treble by frequency bands, which determines a tone color, and also since it can adjust only the bass and treble, it is difficult to realize a tone color that is desired by a listener. In other words, for example, in an existing audio system comprised of an amplifier and a set of (two) speakers, when the bass and treble are adjusted so as to control the low-pitched sound and high-pitched sound, if the bass is increased, a volume level of the low-pitched sound is increased, but volume levels of the middle-pitched sound and high-pitched sound are relatively reduced. And if the treble is increased a volume level of the high-pitched sound is increased, but volume levels of the low-pitched sound and middle-pitched sound are relatively reduced.

Thus, there are technical limitations that it is difficult to exhibit balanced sound, and sound field effect, realism and density of sound are also reduced. Even in the multi-channel and multi-amplifier system, there are technical limitations as described above.

Further, in the conventional audio system, if a volume of sound is increased, noise as well as sound is increased according to SNR (Signal to Noise Ratio) of an amplifier, and thus the whole sound becomes rough.

Furthermore, in the conventional audio system, since a user has to select one of a vacuum tube amplifier and a transistor amplifier and also select one of a closed type speaker and an open type speaker, it is difficult to realize sound having various tone colors.

DISCLOSURE

Technical Problem

An object of the present invention is to provide an apparatus for sound which can delicately and independently realize low-pitched sound, middle-pitched sound and high-pitched sound, and have a low SNR and generate sound having various tone colors.

Technical Solution

To achieve the above objects, the present invention provides an apparatus for sound using multiple amplifiers, comprising a sound source generating unit for generating an electric signal from a sound source; N (N is a positive integer equal to and larger than 2) amplifiers which are connected with the sound source generating unit; and 2N speakers which are respectively connected with left and right output parts of each of the N amplifiers, wherein there is formed a multiple stereo imaging including a first stereo imaging generated by two speakers which are respectively connected with the left and right output parts of one amplifier selected from the N amplifiers; a first mono imaging generated by N speakers which are connected with the left output parts of each of the N amplifiers; a second mono imaging which are connected with the right output parts of each of the N amplifiers; and a second stereo imaging generated by the first mono imaging and the second mono imaging.

Preferably, an output part of the sound source generating unit is connected with an input part of one amplifier selected from the N amplifiers, and the N amplifiers are connected in series so that the output part of one amplifier is connected with the input part of other amplifier.

Preferably, the N amplifiers are connected in parallel so that the output part of the sound source generating unit is connected with the input part of each of the N amplifiers.

Preferably, the N is 2, and the four speakers are arranged in the form of a linear shape.

Preferably, the N is 2, and the four speakers are arranged in the form of a quadrangular shape.

Preferably, the N amplifiers independently control volume, treble and bass.

Preferably, the N amplifiers are comprised of a vacuum tube amplifier, a transistor amplifier or a combination thereof.

Preferably, the 2N speakers are comprised of a closed type speaker, an open type speaker or a combination thereof.

Advantageous Effects

According to the apparatus for sound, it is possible to realize delicate tone color by independently controlling bass, treble and volume using two or more amplifiers, and at the same time, to realize sound having the sound resolution, the density of sound, the sound field effect and the realism as well as the low SNR by generating the multiple stereo imaging using the resonance of sound, and also it is possible to generate sound having various tone colors by combining speakers (the closed type speaker and the open type speaker) and amplifiers (the vacuum tube amplifier and the transistor amplifier) having different tone colors.

DESCRIPTION OF DRAWINGS

The above and other objects, features and advantages of the present invention will become apparent from the following description of preferred embodiments given in conjunction with the accompanying drawings, in which.

DETAILED DESCRIPTION OF MAIN ELEMENTS

Figure 1:
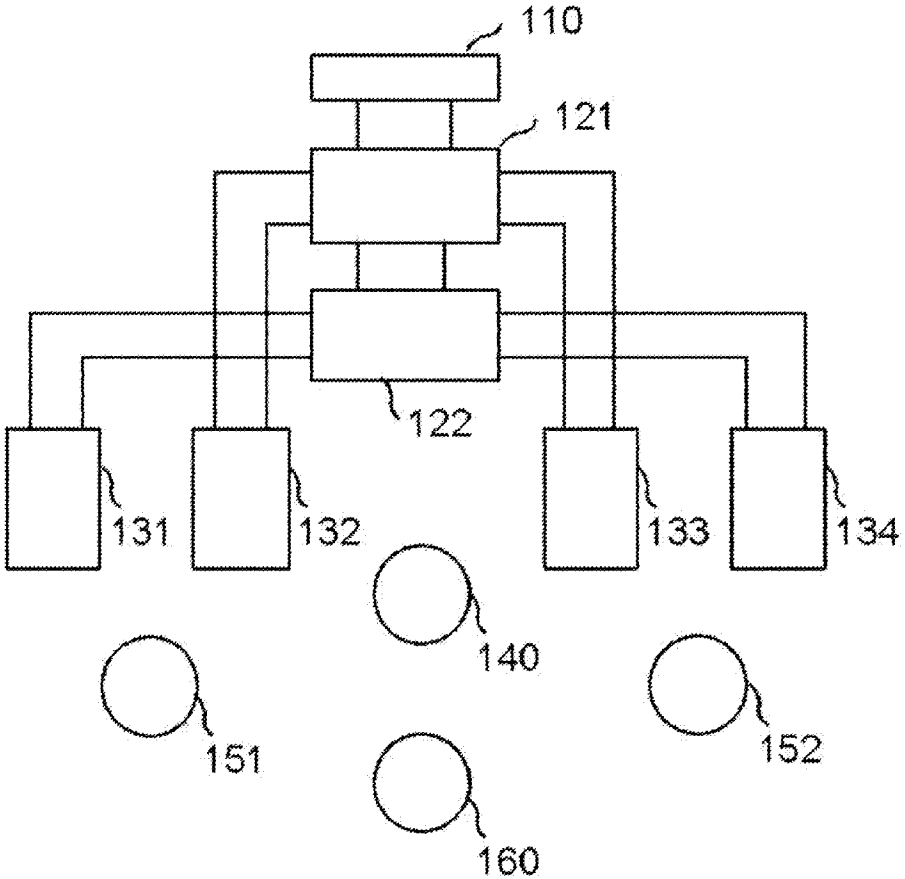
FIG. 1 is a schematic view of an apparatus for sound using a multiple amplifier according to an embodiment of the present invention.

110: a sound source generating unit
121, 122, 321, 322: amplifier
131-134, 231-234, 331-334: speaker
140, 240: first stereo imaging
151, 251: first mono imaging
152, 252: second mono imaging
160, 260: second stereo imaging

BEST MODE

Hereinafter, the embodiments of the present invention will be described in detail with reference to accompanying drawings. The drawings are just examples for explaining ideas in the present invention, and thus the present invention are not limited to the drawings but can be realized in the form of other type. The same reference numerals are used for the same or similar parts the drawings.

Unless defined otherwise, all technical terms and scientific terms used herein the same means as commonly understood by one of ordinary sill in the art to which this invention belongs, and well-known functions and constructions in the drawings and the description, which may undesirably becloud the subject matters of the present invention, will be omitted.

FIG. 1 is a schematic view of an apparatus for sound using a multiple amplifier according to an embodiment of the present invention, wherein two amplifiers 121 and 122, in which volume, treble and bass are independently controlled, are connected in series. As shown in FIG. 1, the apparatus for sound using the multiple amplifier includes a sound source generating unit 110 for generating an electric signal from a digital sound source (not shown) compressively stored in a CD, a DVD, a MD, a magnetic recording medium or a storing medium, a first amplifier 121 for receiving an output of the sound source generating unit 110, a second amplifier 122 for receiving an output of the first amplifier 121, first and second speakers 132 and 133 which are respectively connected with each left and right output part of the first amplifier 121, and third and fourth speakers 131 and 133 which are respectively connected with each left and right output part of the second amplifier 122. In the embodiment of FIG. 1 in which the four speakers 131-134 are linearly arranged, there are generated a first stereo imaging 140 which is formed by resonance of sound generated from the single amplifier 121 and the left and right speakers 132 and 133 connected with the single amplifier 121 like in the conventional type, a first mono imaging 151 which is formed by resonance of sound generated from the left speaker 131 connected with the left output part of the second amplifier 122 and the left speaker 132 connected with the left output part of the first amplifier 121, a second mono imaging 152 which is formed by resonance of sound generated from the right speaker 134 connected with the right output part of the second amplifier 122 and the right speaker 133 connected with the right output part of the first amplifier 121, and a second stereo imaging 160 which is formed by combining the first mono imaging 151 and the second mono imaging 152. Therefore, as described in the embodiment of FIG. 1, since four sound imagings (two stereo imagings and two mono imagings) are formed at different positions by the two amplifiers 121 and 122 and the four speakers 131-134 connected with the left and right output parts of the two amplifiers 121 and 122, the sound resolution, the density of sound, the sound field effect and the realism are remarkably improved. Further, a plurality of sound imagings are largely formed at a listening space, and thus even through each amplifier is operated at a low volume level, it is possible to basically generate big sound. Therefore, since the SNR is improved in the whole system, clean and pure sound can be generated even in the big sound.

At this time, since the two amplifiers 121 and 122 can independently control the volume, the treble and the bass, it is possible to delicately realize a tone color of each of low-pitched sound, middle-pitched sound and high-pitched sound while maintaining a sound balance, and it is facile to control the tone color according to a listener's preference.

Furthermore, the two amplifiers 121 and 122 are comprised of a vacuum tube amplifier, a transistor amplifier or a combination thereof, and the four speakers 131-134 are comprised of a closed type speaker, an open type speaker or a combination thereof, thereby generating sound having various tone colors. In case that the apparatus for sound is comprised of two amplifiers and the four speakers, it is possible to realize sound having 16 tone colors by using the combination of the amplifiers and the combination of the speakers.

Figure 2:
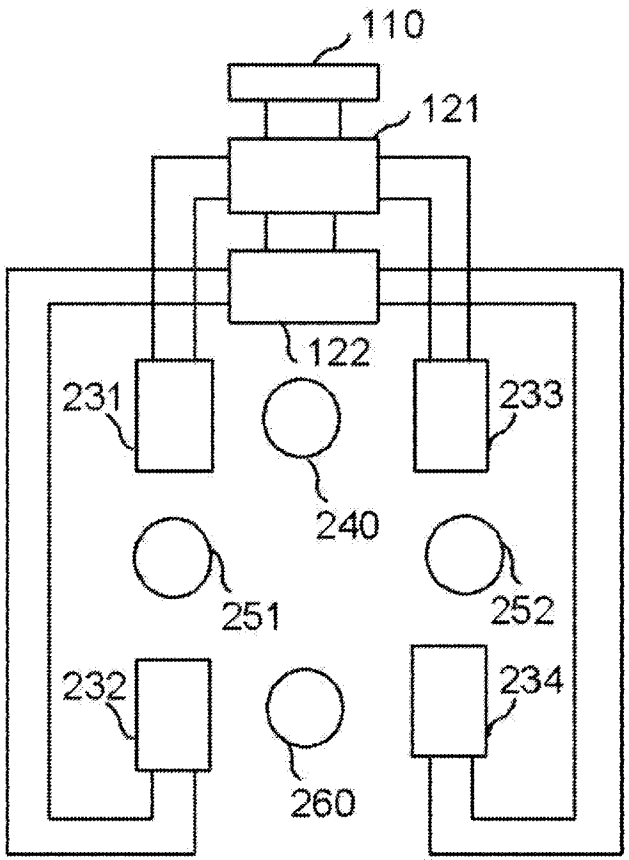
FIG. 2 is a schematic view of an apparatus for sound using a multiple amplifier according to another embodiment of the present invention.

FIG. 2 is a schematic view of an apparatus for sound using a multiple amplifier according to another embodiment of the present invention, wherein two amplifiers 121 and 122, in which the volume, the treble and the bass are independently controlled, are connected in series, and four speakers 231-234 which are respectively connected with the left and right output parts of the two amplifiers 121 and 122 are arranged in the form of a quadrangular shape unlike in the embodiment of FIG. 1.

In the embodiment of FIG. 2 like in the embodiment of FIG. 1, there are generated a first stereo imaging 240 which is formed by resonance of sound generated from the single amplifier 121 and the left and right speakers 231 and 233 connected with the single amplifier 121, a first mono imaging 251 which is formed by resonance of sound generated from the left speaker 232 connected with the left output part of the second amplifier 122 and the left speaker 231 connected with the left output part of the first amplifier 121, a second mono imaging 252 which is formed by resonance of sound generated from the right speaker 234 connected with the right output part of the second amplifier 122 and the right speaker 233 connected with the right output part of the first amplifier 121, and a second stereo imaging 260 which is formed by combining the first mono imaging 251 and the second mono imaging 252.

As described in the embodiments of FIGS. 1 and 2, the plurality of mono imagings and the plurality of stereo imagings are formed by the present invention. Each position of the sound imagings can be controlled by a position of each speaker and a volume of each speaker. Of course, this has to be properly controlled according to a property of a listening space.

Figure 3:
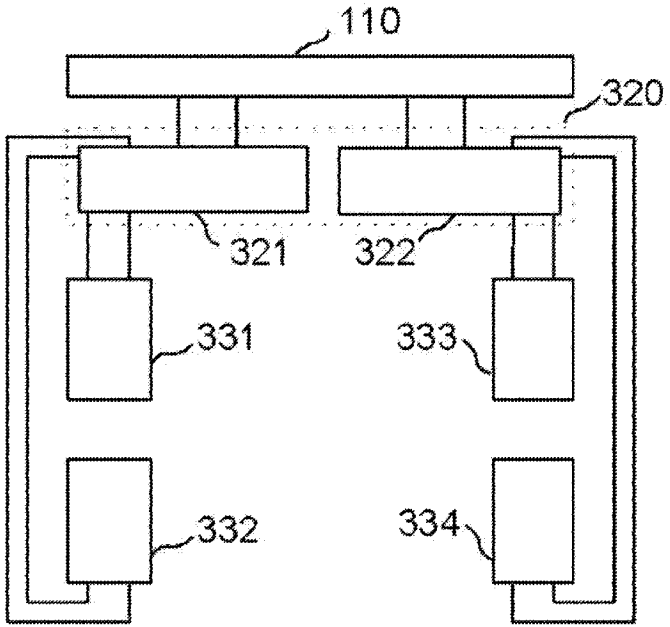
FIG. 3 a schematic view of an apparatus for sound using a multiple amplifier according to yet another embodiment of the present invention.

FIG. 3 a schematic view of an apparatus for sound using a multiple amplifier according to yet another embodiment of the present invention, wherein two amplifiers 321 and 322, in which the volume, the treble and the bass are independently controlled, are connected in parallel, and four speakers 331-334 which are respectively connected with the left and right output parts of the two amplifiers 321 and 322 are arranged in the form of a quadrangular shape like in the embodiment of FIG. 2.

The plurality of amplifiers used in the apparatus for sound may be configured as a series type in which the output part of the front amplifier is connected with the input part of the rear amplifier, as described in the embodiments of FIGS. 1 and 2, and also may be configured as a parallel type in which the output part of the sound source generating unit is connected with each input part of the plurality of amplifiers 321 and 322. Even in case that the plurality of amplifiers are configured in parallel, the volume, the treble and the bass can be independently controlled in each amplifier, and the plurality of amplifiers that are independently operated can be provided in a single case 320.

Figure 4:
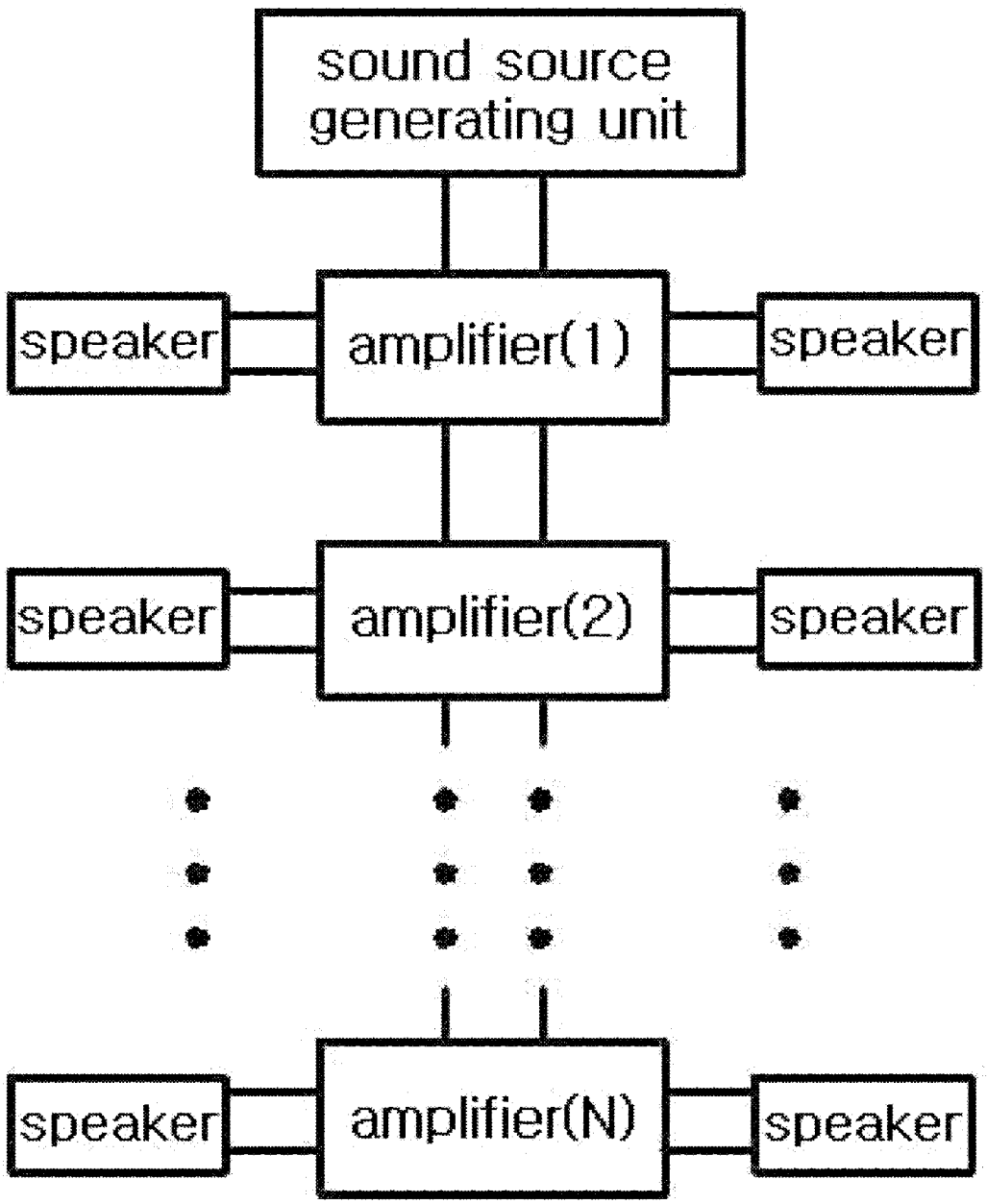
FIG. 4 a schematic view of an apparatus for sound using a multiple amplifier according to yet another embodiment of the present invention.
Figure 5:
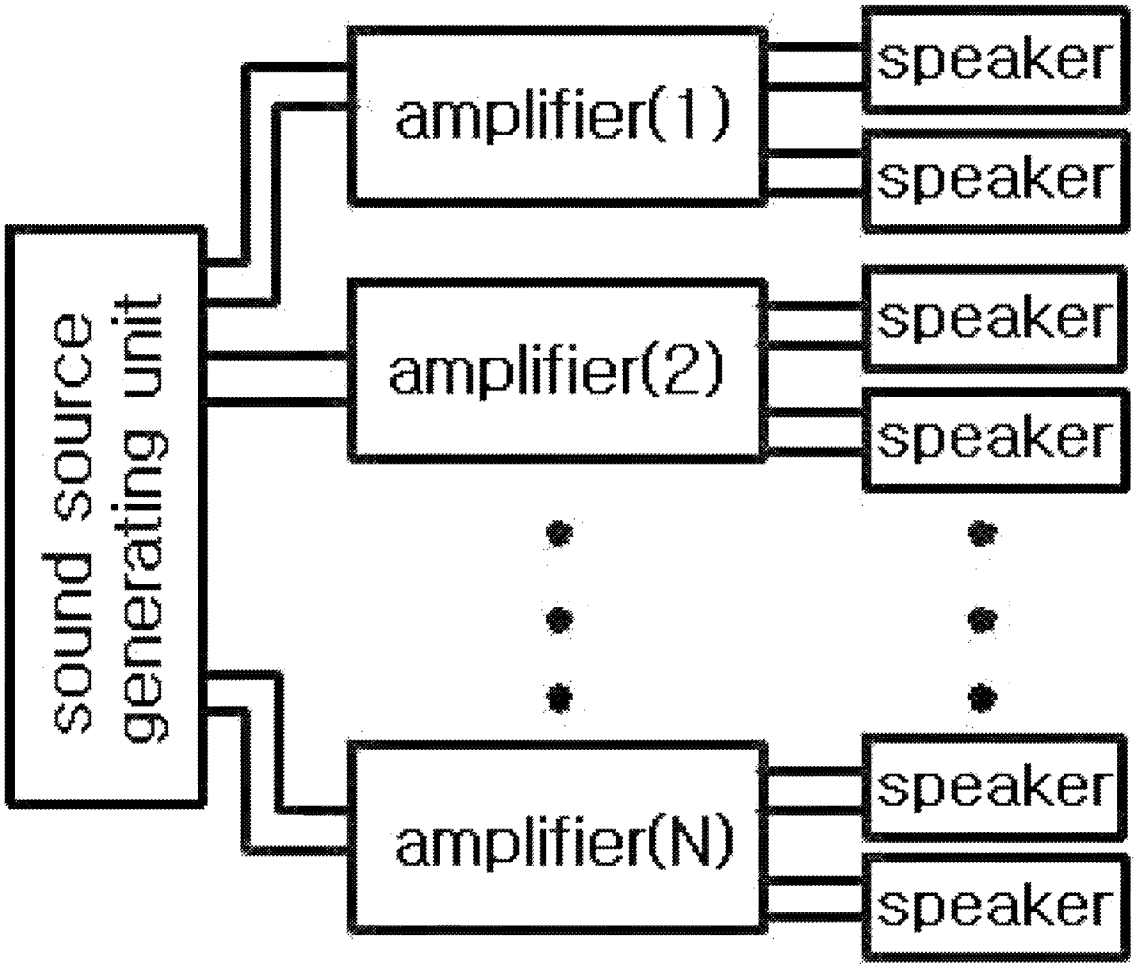
FIG. 5 a schematic view of an apparatus for sound using a multiple amplifier according to yet another embodiment of the present invention.

FIG. 4 a schematic view of an apparatus for sound using a multiple amplifier according to yet another embodiment of the present invention wherein N (N is a positive integer equal to or larger than 2) amplifiers (1.about.N), in which the volume, the treble and the bass are independently controlled, are connected in series, and FIG. 5 a schematic view of an apparatus for sound using a multiple amplifier according to yet another embodiment of the present invention wherein N (N is a positive integer equal to or larger than 2) amplifiers (1.about.N), in which the volume, the treble and the bass are independently controlled, are connected in parallel.

As shown in FIGS. 4 and 5, the apparatus for sound are comprised of N amplifiers (1~N) in which the volume, the treble and the bass are independently controlled, and 2N left and right speakers which are respectively connected with the left and right output parts of the N amplifiers. Also, in the embodiment of FIGS. 4 and 5, there are generated a plurality of stereo imagings and a plurality of mono imagings. Since the plurality of stereo imagings are formed by the plurality of mono imagings, it is possible to reproduce the sound having the improved sound resolution density of sound, sound field effect and realism even in a wide space like an outdoor stadium. Further, since it is possible to basically generate big sound even though each amplifier is operated at a low volume level, clean and pure big sound can be reproduced even in the wide space. Furthermore, since the plurality of amplifiers can be arranged in series as the embodiment of FIG. 4 or in parallel as the embodiment of FIG. 5, it is possible to obtain the same performance as in a large-scaled apparatus of sound using the plurality of low-powered amplifiers, and also it is possible to reproduce the sound having various volumes and tone colors like in the large-scaled apparatus of sound.

As described above, the present invention is described with reference to the particulars like the positions of speakers, the limited embodiments and the drawings, but they are just examples for explaining the ideas of the present invention and the present invention is not limited to them.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

INDUSTRIAL APPLICABILITY

According to the apparatus for sound, it is possible to realize delicate tone color by independently controlling bass, treble and volume using two or more amplifiers, and at the same time, to realize sound having the sound resolution, the density of sound, the sound field effect and the realism as well as the low SNR by generating the multiple stereo imaging using the resonance of sound, and also it is possible to generate sound having various tone colors by combining speakers (the closed type speaker and the open type speaker) and amplifiers (the vacuum tube amplifier and the transistor amplifier) having different tone colors.

The invention claimed is:

1. An apparatus for sound using multiple amplifiers, comprising:

a sound source generating unit for generating an electric signal from a sound source;

N amplifiers which are connected with the sound source generating unit, wherein N is an integer equal to or larger than 2, an output part of the sound source generating unit being connected with an input part of one amplifier selected from the N amplifiers, the N amplifiers being connected in series so that the output part of each amplifier is connected with the input part of another amplifier; and 2N speakers which are respectively connected with left and right output parts of each of the N amplifiers, wherein there is formed a multiple stereo imaging including a first stereo imaging generated by two speakers which are respectively connected with the left and right output parts of one amplifier selected from the N amplifiers;

a first mono imaging generated by N speakers which are connected with the left output parts of each of the N amplifiers;

a second mono imaging which are connected with the right output parts of each of the N amplifiers; and a second stereo imaging generated by the first mono imaging and the second mono imaging.

2. The apparatus for sound according to claim 1, wherein the N is 2, and the four speakers are arranged in form of a linear shape.

3. The apparatus for sound according to claim 1, wherein the N is 2, and the four speakers are arranged in form of a quadrangular shape.

4. The apparatus for sound according to claim 1, wherein the N amplifiers independently control volume, treble and bass.

5. The apparatus for sound according to claim 1, wherein the N amplifiers are comprised of a vacuum tube amplifier, a transistor amplifier or a combination thereof.

6. The apparatus for sound according to claim 1, wherein the 2N speakers are comprised of a closed type speaker, an open type speaker or a combination thereof.

* * * * *

UNITED STATES PATENT AND TRADEMARK OFFICE

CERTIFICATE OF CORRECTION

PATENT NO. : 8,559,644 B2
APPLICATION NO. : 12/733194
DATED : October 15, 2013
INVENTOR(S) : Chung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 431 days.

Signed and Sealed this
Fifteenth Day of September, 2015

Michelle K. Lee

Michelle K. Lee
*Director of the United States Patent and Trademark Office*